US009157450B2

(12) United States Patent
Sugimura et al.

(10) Patent No.: US 9,157,450 B2
(45) Date of Patent: Oct. 13, 2015

(54) IMPELLER AND TURBOMACHINERY INCLUDING THE IMPELLER

(75) Inventors: Kazuyuki Sugimura, Hitachinaka (JP); Hideo Nishida, Kasumigaura (JP); Hiromi Kobayashi, Kasumigaura (JP); Toshio Ito, Ushiku (JP)

(73) Assignee: HITACHI, LTD., Tokyo (JP)

( * ) Notice: Subject to any disclaimer, the term of this patent is extended or adjusted under 35 U.S.C. 154(b) by 610 days.

(21) Appl. No.: 13/437,958

(22) Filed: Apr. 3, 2012

(65) Prior Publication Data

US 2012/0263599 A1 Oct. 18, 2012

(30) Foreign Application Priority Data

Apr. 13, 2011 (JP) ..... 2011-089338

(51) Int. Cl.
*F04D 29/30* (2006.01)
*F04D 29/28* (2006.01)

(52) U.S. Cl.
CPC ..... *F04D 29/284* (2013.01); *F04D 29/30* (2013.01)

(58) Field of Classification Search
CPC ..... F04D 29/284; F04D 29/30
USPC ..... 416/182, 183, 185, 188, 223 B, 197 R, 416/DIG. 2; 415/218.1
See application file for complete search history.

(56) References Cited

U.S. PATENT DOCUMENTS

| | | | | |
|---|---|---|---|---|
| 2,042,064 | A * | 5/1936 | Kugel | 416/188 |
| 4,502,837 | A | 3/1985 | Blair | |
| 7,476,082 | B2 * | 1/2009 | Vogiatzis et al. | 416/188 |

FOREIGN PATENT DOCUMENTS

| | | |
|---|---|---|
| JP | 59-90797 | 5/1984 |
| JP | 4115180 | 4/2008 |

* cited by examiner

*Primary Examiner* — Richard Edgar
(74) *Attorney, Agent, or Firm* — Mattingly & Malur, PC

(57) ABSTRACT

An impeller includes a hub plate and a plurality of blades circumferentially disposed at intervals on one surface side of the hub plate. Each blade has a shape formed by piling up a plurality of blade sections in a blade height-wise direction of each blade in a reference impeller in which the hub plate intersects with the blades and which includes a linear element blade in the blade height-wise direction so as to form a curvilinear element blade. In piling up the blade sections, amounts of tangential lean and sweep to be applied to the blade sections are increased as it goes from an end face of at least one of a hub plate side end and a counter hub plate side end toward a span intermediate part of the blade.

6 Claims, 11 Drawing Sheets

IMPELLER AND TURBOMACHINERY INCLUDING THE IMPELLER

BACKGROUND OF THE INVENTION

1. Field of the Invention

The present invention relates to an impeller such as a centrifugal impeller, a mixed-flow impeller or the like and turbomachinery including the impeller, and more particularly to turbomachinery for applying energy to a working fluid such as a compressor, a blower, a fan, a pump and the like including centrifugal impellers or mixed-flow impellers.

2. Description of the Related Art

A multi-stage compressor which is a kind of turbomachinery has such a configuration that stages, each including many coaxially attached centrifugal impellers or mixed-flow impellers, and diffusers and return guide vanes which are juxtaposed downstream of the respective impellers, are piled up. In an impeller used in the above multi-stage compressor, a blade is produced by cutting work in many cases. If it is allowed to define a blade-surface shape of a blade included in the impeller as an assembly of linear elements, use of a rod-shaped cutting tool such as a mill or the like will be allowed. In the above mentioned case, a side surface of a working tool is brought into abutment on a part of the blade to be worked as a linear element while rotating it and the blade is cut while sliding it in a direction from the entrance side to the exit side of the impeller or in its reverse direction. Owing to the above, efficienct working is attained. Since a linear element impeller (an impeller including linear elements) is excellent in productivity and workability as described above, the linear element impeller is frequently used in a centgrifugal compressor.

Although adoption of a linear element impeller is an effective method from the viewpoint of production, it is desirable to release a blade for use in an impeller from such a restriction that it is defined as an assembly of linear elements, to let it have a blade surface including a free surface so as to finely control a blade passage flow, in order to fulfill the requirements of the times that impeller performance be further improved. In the following, in the present invention, an impeller in which a blade surface includes a free surface will be referred to as a curvilinear element impeller.

Examples of an impeller that partially includes curvilinear elements are disclosed in Japanese Patent Application Laid-Open No. Sho59-90797/1984 and Japanese Patent No. 4115180. An impeller disclosed in Japanese Patent Application Laid-Open No. Sho59-90797 is an open impeller (hereinafter, also referred to as a half-shrouded impeller as the case may be) that does not include any shroud plate (a side plate) on the side of a shroud of the impeller. Although an impeller disclosed in Japanese Patent No. 4115180 is the same as that in Japanese Patent Application Laid-Open No. Sho59-90797 in that any shroud plate (a side plate) is not included on the side of its shround, it is a half-shrouded impeller with half vane that includes, between two blades, a blade which is shorter than these two blades in entrance-side dimension. Incidentally, an impeller that includes a shroud plate (a side plate) on the side of a shroud is referred to as a closed impeller (hereinafter, also referred to as a fully-shrouded impeller as the case may be).

The impeller disclosed in Japanese Patent No. 4115180 is a curvilinear element impeller. Blades used in the curvilinear element impeller are formed by piling up blades the sections of which are curved in a span-wise direction in the vicinity of leading edges of the blades when an airfoil is to be formed.

Owing to the above, accumulation of a low energy fluid onto an area of a blade flow passage is restricted to improve compressor efficiency.

In the above mentioned Japanese Patent Application Laid-Open No. Sho59-90797 and Japanese Patent No. 4115180, improvement of compressor efficiency is promoted by changing the configuration of a part around a blade leading edge from an ever used one in the half-shrouded impeller. In the half-shrouded impeller used in a centrifugal impeller or a mixed-flow impeller, a tip leakage flow generates. On the other hand, in a fully-shrouded impeller, any tip leakage flow does not generate. Thus, it may not be ensured that an optimum curvilinear element impeller which is expected to improve performance in a half-shrouded impeller is obtained due to a difference in flow pattern between blades even when a blade of the shape which has been the best in a half-shrouded impeller is used. That is, the blade shape with which an optimum curvilinear element impeller is obtained may be different depending on the situation.

A method of forming curvilinear elements which is suited for a fully-shrouded impeller may not be definitely established as mentioned above. However, it may be easily imagined that the number of curvilinear element forming patterns which would lead to performance improvement in reality is rather limited for numerous curvilinear element impeller forming methods and hence it becomes desirable to find out curvilinear element forming patterns which would lead to performance improvement.

BRIEF SUMMARY OF THE INVENTION

The present invention has been made in view of the above mentioned circumstances of related art. An object of the present invention is to improve the performance of turbomachinery in a centrifugal impeller or a mixed-flow impeller included in the turbomachinery. Another object of the present invention is to effectively restrict a secondary flow between blades of a curvilinear element impeller. A further object of the present invention is to implement an optimum curvilinear element forming method, that is, an optimum pattern of piling up blade sections in a span-wise direction which would lead to performance improvement in a curvilinear element impeller.

Since a curvilinear element impeller is given by way of example in the present invention, first, definitions of technical terms involving the curvilinear element impeller will be described hereinbelow.

[Curvilinear Element Impeller]

An impeller of the type that a shroud surface and a hub surface of the impeller are connected with each other with a curve and a plurality of the curves are arranged from the entrance side to the exit side to produce a blade will be defined as a curvilinear element impeller. This concept is contrastive to that of a linear impeller.

In formation of a curvilinear element impeller, the shape of a blade for use in a linear impeller which would serve as a reference is determined and blade sections are cut off at various positions on a span of the linear impeller. Then, the cut-off blade sections are linearly moved, and rotationally moved or deformed, and are piled up again. Thus, a curvilinear element impeller having a free surface is obtained. In the following, a specific method of forming a curvilinear element impeller as mentioned above will be described with reference to FIG. 1A, FIG. 1B and FIG. 2.

FIG. 1A and FIG. 2 are diagrams illustrating a method of moving or deforming one cut-off blade section. FIG. 1A is a diagram of a blade section which is illustrated on the basis of a cylindrical coordinate system. A position on the span (directed perpendicularly to the paper surface in FIG. 1A) is an arbitrary position. FIG. 1B is a diagram of the blade section which is the same as that in FIG. 1A and is extended so as to be illustrated on the basis of a Cartesian coordinate system. In the drawings, the horizontal axis is a meridional stream line direction m and the vertical axis is a circumferential direction (θ direction).

FIG. 2 is a perspective view illustrating a state that cut-off blade sections as illustrated in FIG. 1A and FIG. 1B are piled up to form a curvilinear impeller. In FIG. 2, one blade which has been extracted from the impeller is illustrated. Within a meridional plane (an R-Z plane), a non-dimensional blade height is defined as h/H when a span-wise height from a hub 110 to each blade section along a linear element of interest is h and an overall span-wise height from the hub 110 to a shroud 120 along the linear element is H.

[Tangential Lean]

Tangential lean means to move a blade section V of an impeller in the circumferential direction (θ direction) with the shape of the blade section V maintained congruent. In the case that the blade section is rotationally moved in a direction of rotation of the impeller, it is defined that a positive tangential lean is applied.

In the examples in FIG. 1A and FIG. 1B, movement from the position of a blade section 101 to the position of a blade section 102 is Tangential lean. In the above mentioned case, a moving amount is δθ (*rad*) when expressed by the cylindrical coordinate system (FIG. 1A) and a moving amount in a vertical axis direction is δY when expressed by the Cartesian coordinate system (FIG. 1B).

[Blade Chord]

A line connecting between a leading edge 202 and a trailing edge 203 of the blade section V is defined as a blade chord C and a direction from the leading edge 202 to the trailing edge 203 is defined as a positive direction.

[Sweep]

Sweep means to deform a camber line of the blade section V in a direction of the blade chord C in a state that the position of the trailing edge 203 is fixed and the shape of the camber line is maintained almost analogous. Deformation in a positive chord-wise direction is defined as positive sweep.

Since a blade thickness th is changed as the shape of the blade section V, that is, the contour shape itself of a blade surface is analogously deformed, only the camber line is deformed almost analogously, by which the blade thickness th may be arbitrarily set. Incidentally, after deformed, a leading edge 202*a* is positioned on the line of the blade chord C obtained before deformed. In FIG. 1A and FIG. 1B, it is illustrated as analogous deformation from the blade section 101 to a blade section 103. Here, the trailing edge 203 is fixed in order to maintain an impeller outer diameter R2 constant so as not to largely change a theoretical head. If changing of the theoretical head is allowable, it may not be always necessary to fix the position of the trailing edge 203.

Under definitions as described above, in order to attain the above mentioned objects, according to one embodiment of the present invention, there is provided an impeller that includes a hub plate and a plurality of blades circumferentially disposed at intervals on one surface side of the hub plate, wherein each of the plurality of blades has a shape formed by piling up a plurality of blade sections in a blade height-wise direction of each blade in a reference impeller in which the hub plate intersects with the blades and which includes a blade configured by a linear element in the blade height-wise direction so as to form a curvilinear element blade, and when rotational movement of the blade sections in a direction of rotation of the impeller is defined as application of a positive tangential lean, in piling up the blade sections in the blade height-wise direction, an amount of the tangential lean to be applied to the blade sections is increased as it goes from an end face of at least one of a hub plate side end and a counter hub plate side end toward a span intermediate part of the blade.

Then, in the impeller, when almost analogous deformation and movement of the blade sections in a blade chord downstream direction is defined as application of a positive sweep, in piling up the blade sections in the blade height-wise direction, it is preferable that an amount of the sweep to be applied to the blade sections be increased as it goes from an end face of at least one of the hub plate side end and the counter hub plate side end toward the span intermediate part of the blade. It is also preferable that the amount of the tangential lean applied to the side of the hub be larger than that applied to the side of a shroud. It is further preferable that a maximum value of the applied amounts be obtained at a blade height which is closer to the hub side than to a span central part.

According to another embodiment of the present invention, there is also provided an impeller that includes a hub plate and a plurality of blades which are circumferentially disposed at intervals on one surface side of the hub plate, wherein an angle between a suction surface of the blade and at least one of a surface of the hub plate and a surface opposite to the blade at a counter hub plate side end is made obtuse angle.

In the impeller, it is preferable that an angle between at least one of the surface of the hub plate and the surface opposite to the blade at the counter hub plate side end within a meridian plane and a ridge line of leading edges of the blade be made acute angle on the side including the blade.

According to a further embodiment of the present invention, there is further provided an impeller that includes a hub plate and a plurality of blades which are circumferentially disposed at intervals on one surface side of the hub plate, wherein each of the plurality of blades has a shape formed by piling up the blade sections in a blade height-wise direction and is a curvilinear element blade formed by piling up the blade section in the blade height-wise direction along a curve when piling up the blade sections, and a suction surface of each of the blades in a shape that the impeller is extended over the same radius the most precedes in a direction of rotation of the impeller at a position which is closer to the side of the hub plate than to a bladespan central part.

In any of the above mentioned cases, it is preferable that the impeller be a centrifugal impeller or a mixed-flow impeller.

Further, according to the present invention, there is provided turbomachinery that includes at least one or more impellers described in any one of the above mentioned items.

According to the present invention, in a centrifugal impeller or a mixed-flow impeller, since the shape of a blade section on the exit side of an impeller is protruded in a direction of rotation and the shroud side is retreated relative to the hub side, a secondary flow with which accumulation of a low energy fluid onto a corner part of a blade passage flow is accelerated may be restrained to increase performance of the turbomachinery. In addition, if the above impeller is a curvilinear element impeller, the shape with which the secondary flow may be further restrained will be obtained and hence the turbomachinery performance will be further improved. Further, an optimum curvilinear element forming method, that is, an optimum pattern of piling up blade sections in a span-wise direction which would lead to performance improvement may be implemented by combining sweep with Tangential lean.

DETAILED DESCRIPTION OF THE INVENTION

Figure 1A:
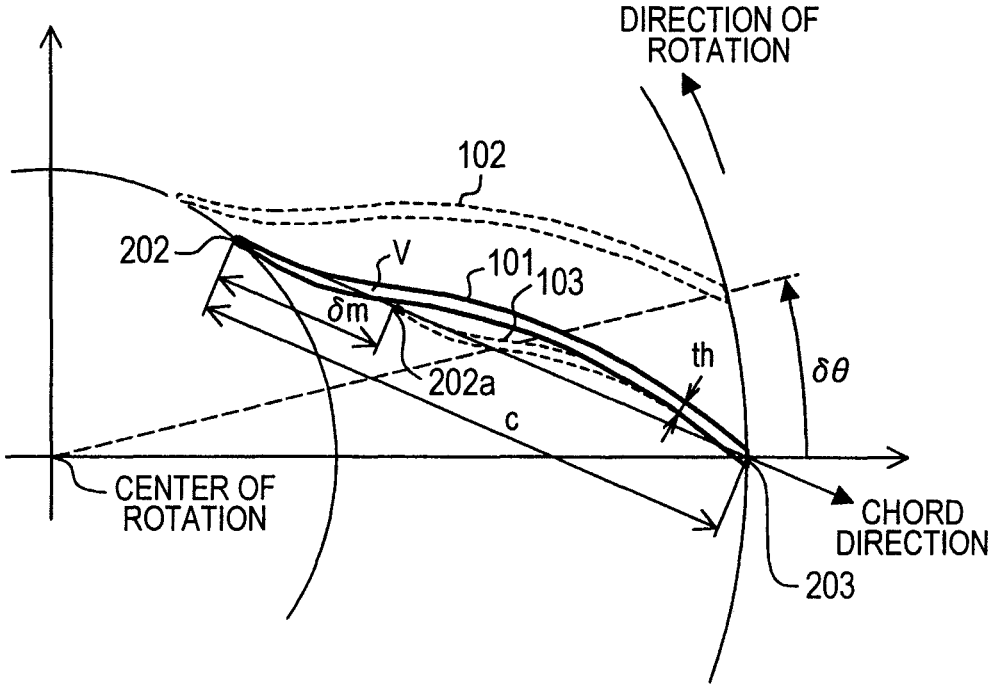
FIG. 1A and FIG. 1B respectively illustrate a sectional diagram of a meridional plane and an extend elevation thereof illustrating an impeller according to the present invention.
Figure 1B:
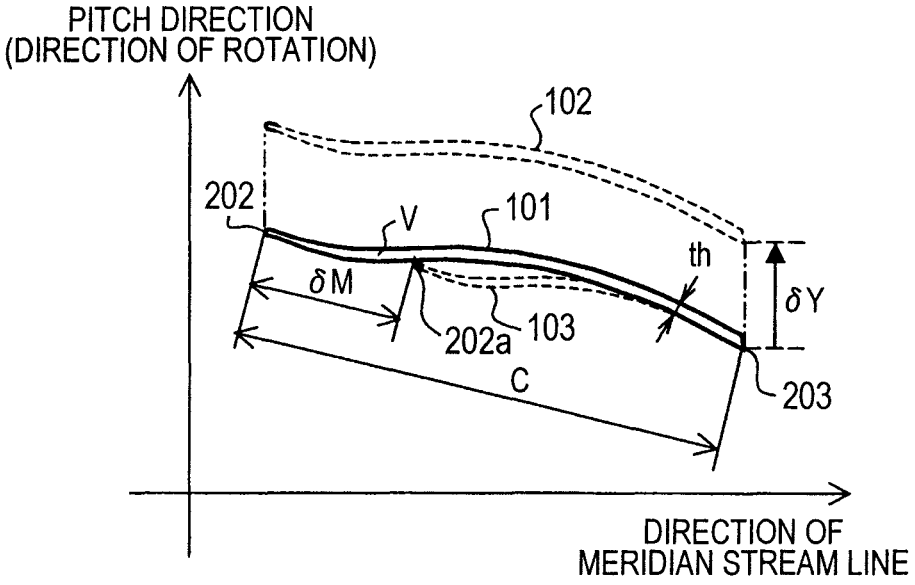
Figure 2:
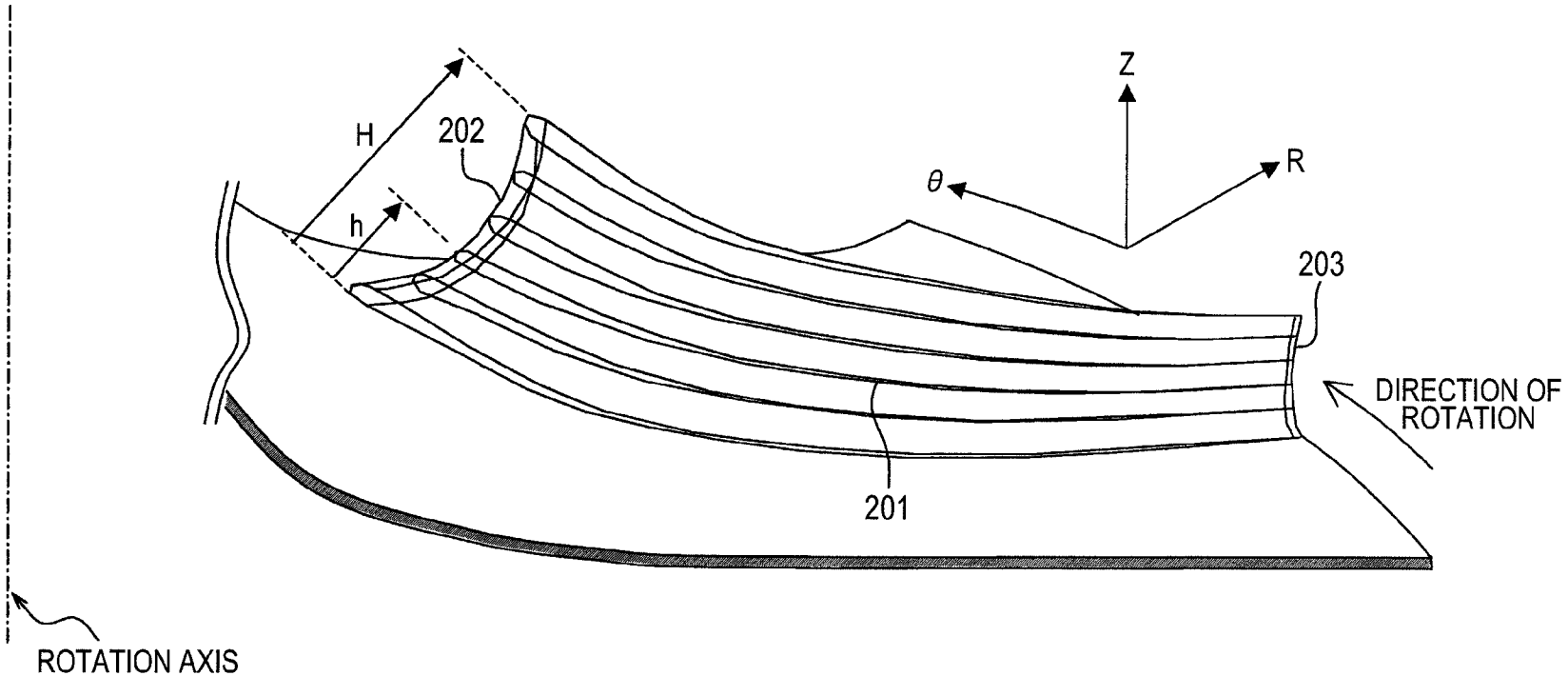
FIG. 2 is a perspective view illustrating an impeller according to the present invention.
Figure 3:
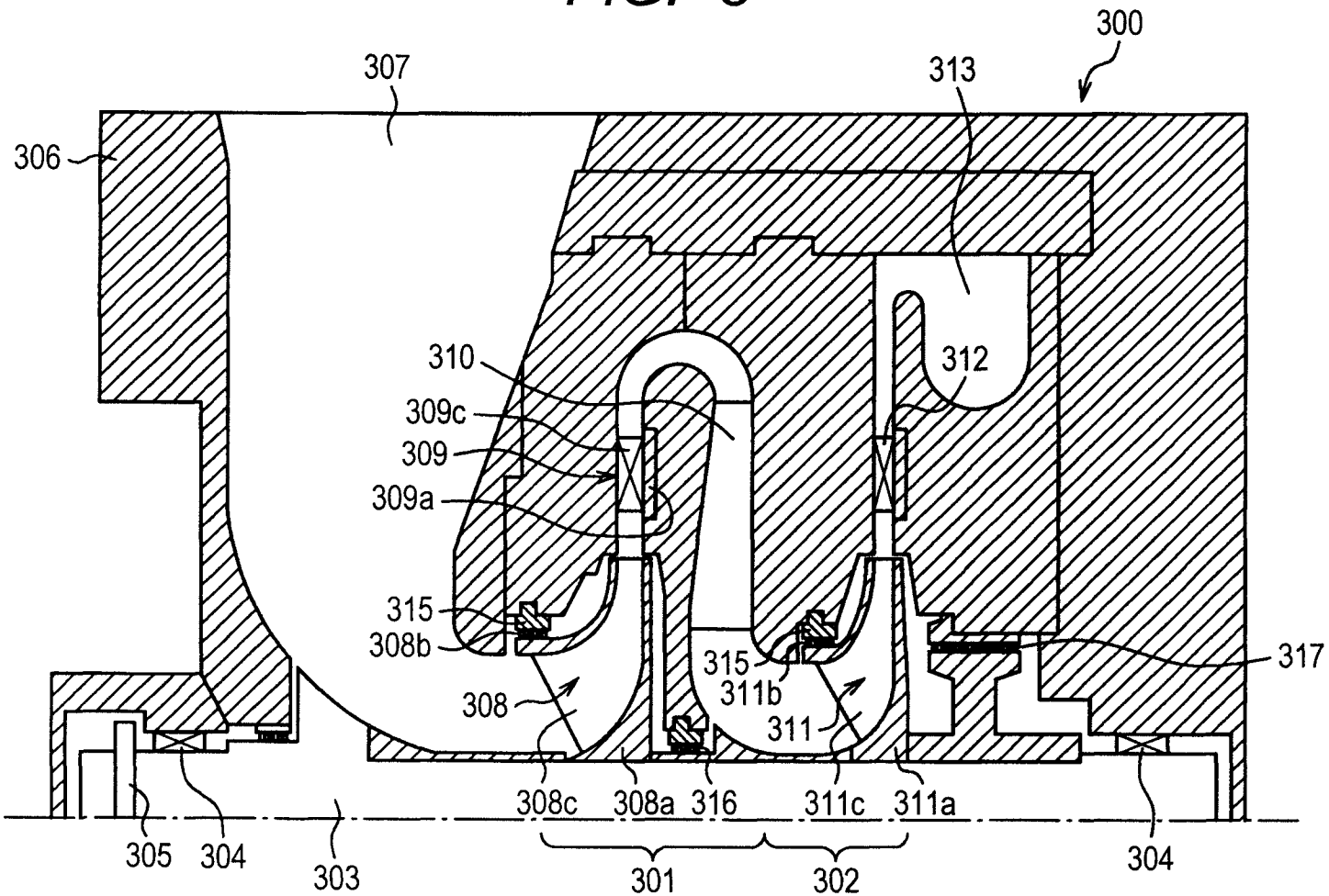
FIG. 3 is a longitudinal sectional diagram of an embodiment of a multi-stage centrifugal compressor according to the present invention.

Several embodiments of the present invention will be described with reference to the accompanying drawings. First, a two-stage centrifugal compressor will be described as an example of turbomachinery. FIG. 3 is a longitudinal sectional diagram of the two-stage centrifugal compressor. Although the two-stage centrifugal compressor is given as an example of a multi-stage centrifugal compressor 300 here, the present invention is applicable to single-stage or multi-stage turbomachinery including centrifugal impellers or mixed-flow impellers, not limited to the two-stage centrifugal compressor.

The two-stage centrifugal compressor 300 includes a first stage 301 and a second stage 302. A first-stage impeller 308 and a second-stage impeller 311 are mounted to the same rotational axis 303 to configure a rotor. The rotational axis 303, and the first-stage and second-stage impellers 308 and 311 are housed in a compressor casing 306 and are rotatably supported by a journal bearing 304 and a thrust bearing 305 held by the compressor casing 306.

A diffuser 309 that recovers a pressure of an operating gas which has been compressed by the impeller 308 to form a radially outward flow and a return guide vane 310 that turns the flow of the operating gas which has been directed radially outward to a radially inward flow and guides the radially inward flow to the second-stage impeller 311 are disposed downstream of the first-stage impeller 308. Similarly, a diffuser 312 and a pressure recovery unit 313 which is called a collector or a scroll for sending the operating gas the pressure of which has been increased by the two-stage diffuser 312 to the outside in the lump are disposed downstream of the second-stage impeller 311.

The first-stage impeller 308 includes a hub plate 308*a*, a shroud plate 308*b*, and a plurality of blades 308*c* which are circumferentially disposed almost at equal intervals between the hub plate 308*a* and the shroud plate 308*b*. Similarly, the second-stage impeller 311 includes a hub plate 311*a*, a shroud plate 311*b*, and a plurality of blades 311*c* which are circumferentially disposed almost at equal intervals between the hub plate 311*a* and the shroud plate 311*b*. On the entrance side of each of the impellers 308 and 311, a mouth labyrinth seal 315 is disposed on an outer peripheral part of each of the shroud plates 308*b* and 311*b* and a stage labyrinth seal 316 and a balance labyrinth seal 317 are respectively disposed on the rear surface sides of the hub plates 308*a* and 311*a*.

The operating gas that has entered through a suction nozzle 307 passes through the first-stage impeller 308, the vaned diffuser 309, the return guide vane 310, the second-stage impeller 311 and the vaned diffuser 312 in this order and is guided to the recovery unit 313 such as a collector or a scroll. Although vaned diffusers are illustrated in FIG. 3 as the diffusers, vaneless diffusers may be used.

Figure 4B:
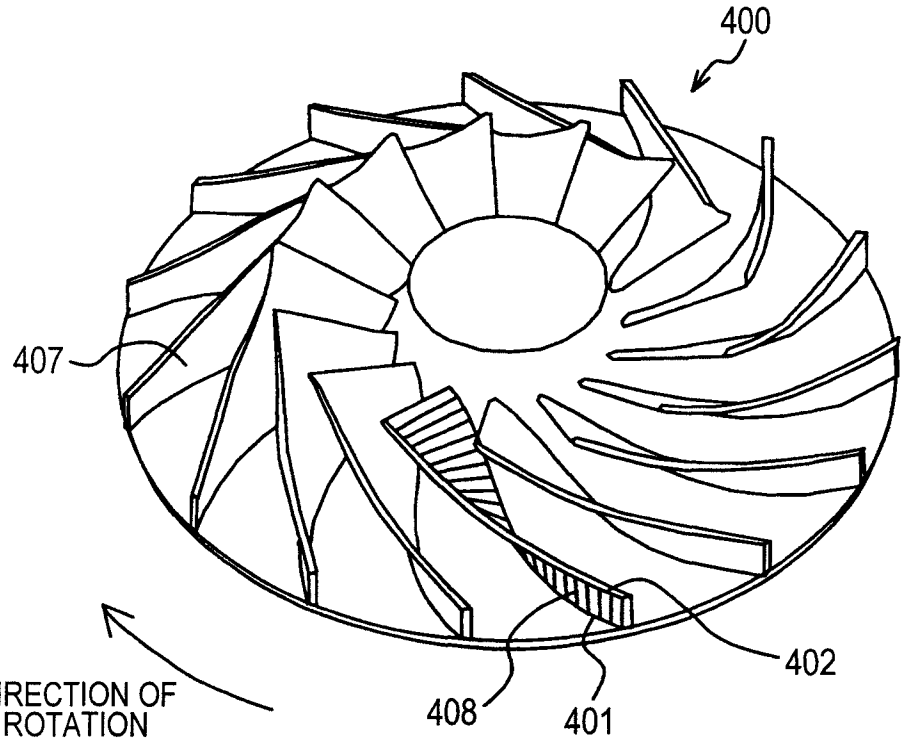
FIG. 4A and FIG. 4B are a sectional diagram of a meridional plane and a perspective view of one example of a conventional centrifugal compressor.
Figure 4A:
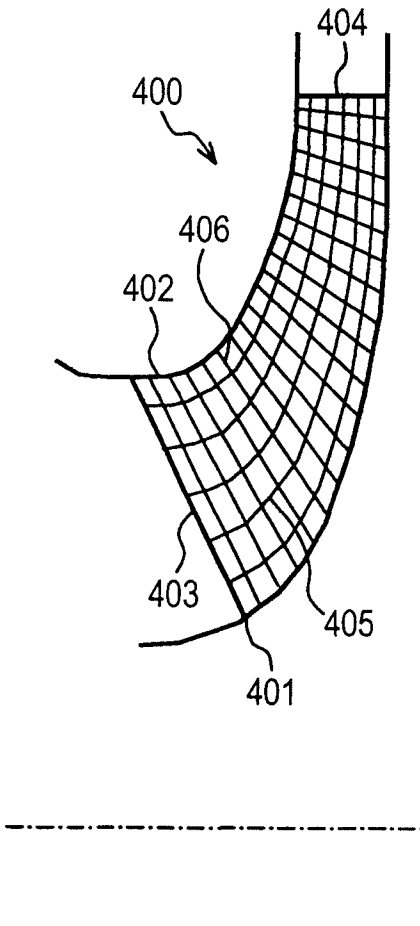

A linear element impeller 400 according to related art is illustrated in FIG. 4A and FIG. 4B for the convenience of explanation. A camber surface of a blade 407 on a meridional plane is illustrated in FIG. 4A. A hub-side boundary 401 and a shroud-side boundary 402 that configure the camber surface, and camber lines 405 of five blade sections positioned between the boundary lines 401 and 402 are illustrated. Thus, in the impeller illustrated in FIG. 4A, seven blade sections are used in all and the blade 407 of the impeller 400 is specified by these seven blade sections. Numeral 403 is a leading edge of the blade 407 and numeral 404 is a trailing edge of the blade 407. A plurality of linear elements 406 are used for piling up the blade sections in the impeller 400.

FIG. 4B is a perspective view of the impeller 400. A surface of the blade 407 is configured as an assembly of linear elements 408 directed from the hub-side boundary 401 to the shroud-side boundary 402. The linear element is illustrated as the linear element 406 in FIG. 4A and as the linear element 408 in FIG. 4B. It is difficult for the linear element impeller 400 as illustrated in FIG. 4B to finely control a secondary flow formed between blades.

Figure 5B:
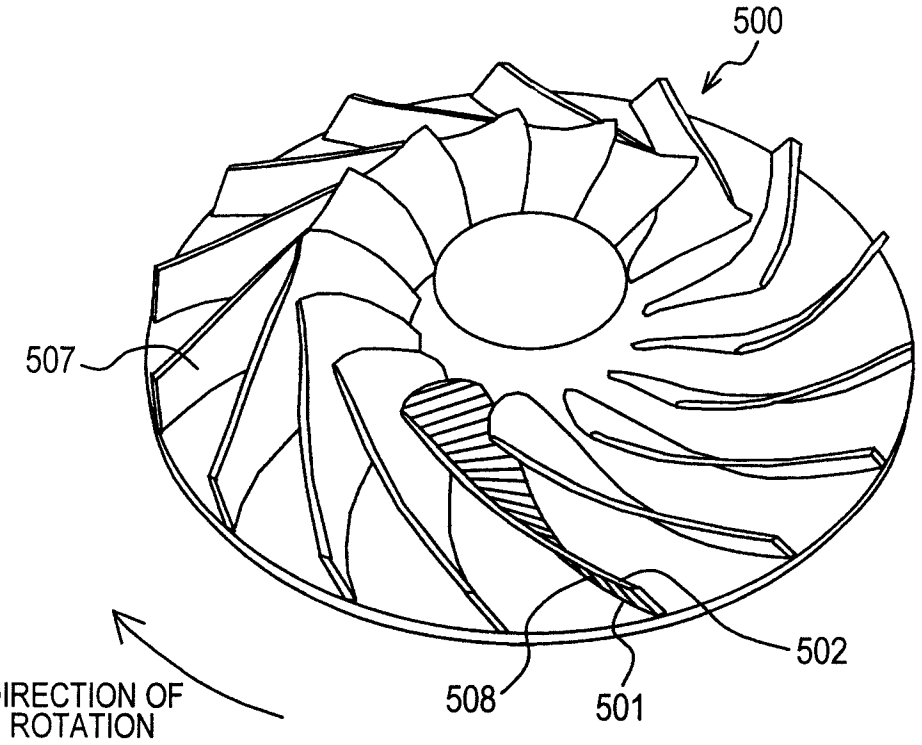
FIG. 5A and FIG. 5B are a sectional diagram of a meridional plane and a perspective view of another example of the conventional centrifugal compressor.
Figure 5A:
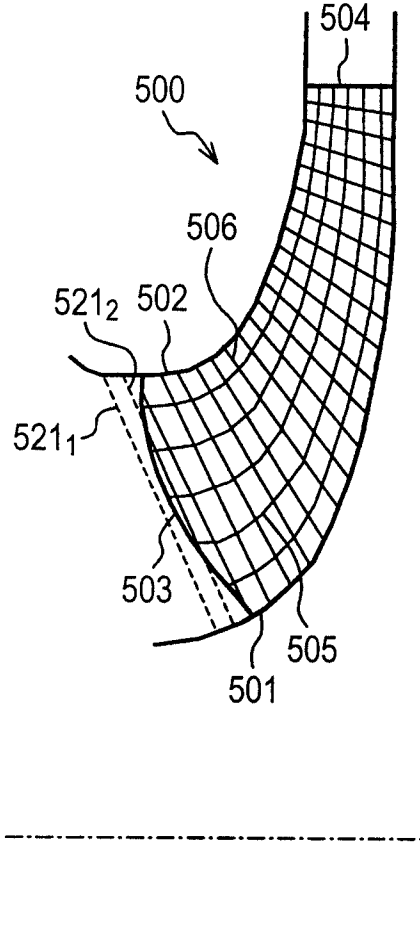

FIG. 5A and FIG. 5B illustrate another example of the conventional impeller as a linear element impeller 500. The impeller 500 is different from the impeller 400 in FIG. 4A and FIG. 4B in that a leading edge of a blade 507 is not configured by one linear element and a surface formed by a plurality of adjacent linear elements 521*i* (i=1, 2, . . . ) is cut so as to be protruded toward the entrance side in the shape of a meridional plane. That is, a ridge line 503 defined by connecting together leading edges of respective blade sections from the hub side toward the shroud side is curved in a blade height-wise direction. In this related art example, blade sections 505 are piled up along a linear element 506 or 508 to form a blade 507 as in the case of the related art example in FIG. 4A and FIG. 4B. Incidentally, the linear element is illustrated as the linear element 506 in FIG. 5A and as the linear element 508 in FIG. 5B. The flow in the vicinity of a blade leading edge 503 is controlled to some extent in the impeller 500. However, since the characteristic of the blade passage flow is substantially the same as that of the impeller 400 illustrated in FIG. 4A and FIG. 4B, it is difficult to sufficiently control the secondary flow.

Figure 6B:
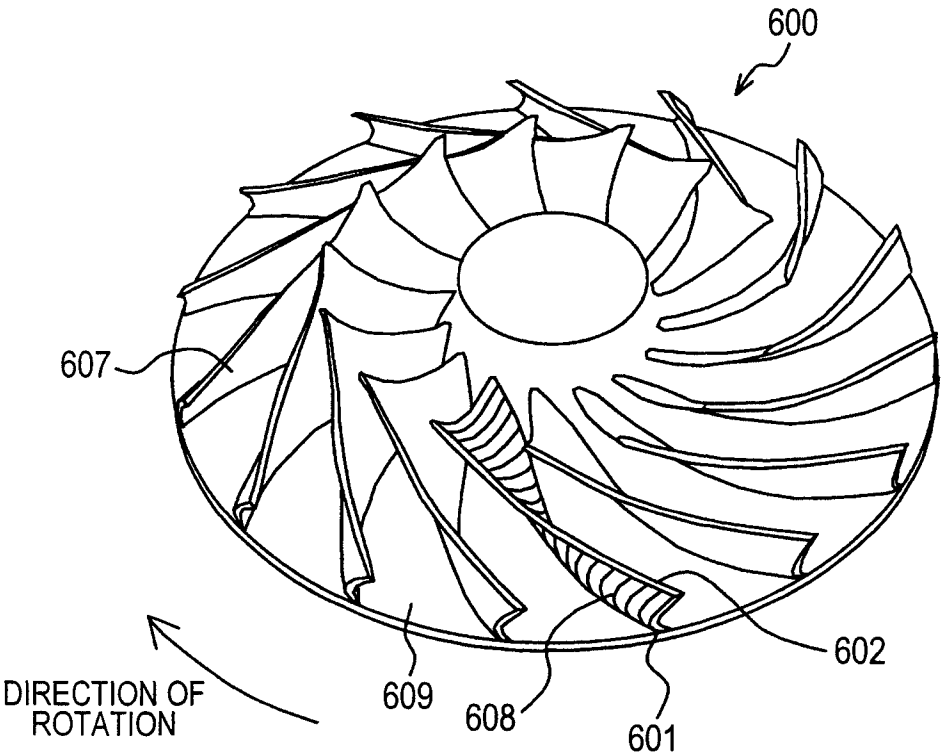
FIG. 6A and FIG. 6B are a sectional diagram of a meridional plane and a perspective view of one embodiment of a centrifugal compressor according to the present invention.
Figure 6A:
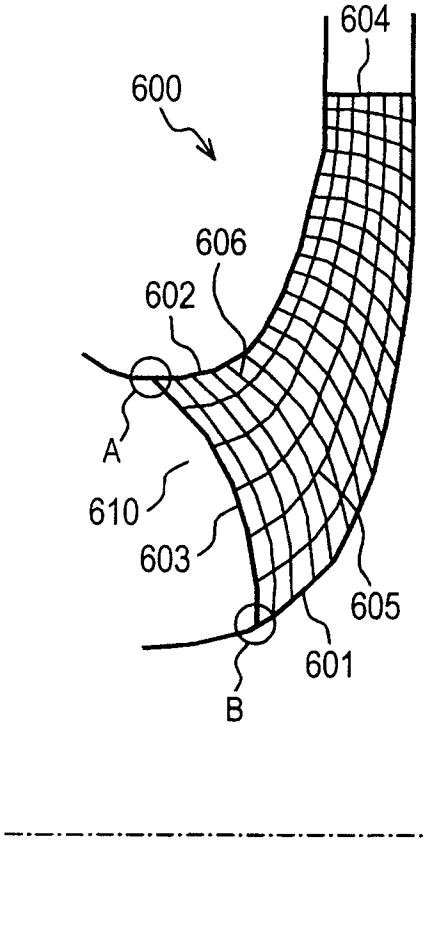

In the following, several embodiments of the present invention will be described with reference to FIG. 8 to FIG. 12 while comparing them with the above related art examples. FIG. 6A and FIG. 6B are diagrams illustrating one embodiment of a curvilinear element impeller according to the present invention, in which FIG. 6A is a diagram illustrating the shape of a meridional plane (R-Z plane) shape of a curvilinear element impeller 600 and FIG. 6B is a perspective view thereof.

In FIG. 6A, a flow passage 610 is defined by a hub-side boundary 601 and a shroud-side boundary 602 in the curvilinear element impeller 600. Curvilinear element blades 607, each including a plurality of curvilinear elements 606, are circumferentially disposed at intervals within the flow passage 610. In FIG. 6A, the blade 607 is illustrated by using blade sections 605. A curvilinear element 606 serves as a guide for piling up the blade sections. Although a curvilinear element 606 may look like a linear element in a projection drawing of the meridional plane in some cases as described later (see FIG. 9A and FIG. 9B), it is curved in actual shape.

As illustrated in FIG. 6B, in the curvilinear element impeller 600, the plurality of blades 607 are circumferentially disposed almost at equal intervals on one surface of a hub plate 609. The blade 607 is configured by piling up the blade sections along a curvilinear element 608 from the hub-side boundary 601 toward the shroud-side boundary 602 and a surface of the blade is formed as a free surface. Since the present invention adopts curvilinear elements, its degree of freedom of piling up the blade sections is higher than that of a linear element impeller. Thus, it is allowed to freely incline the surface of each blade and hence control of a direction of force applied to a fluid, that is, a secondary flow formed between blades is allowed.

Figure 7:
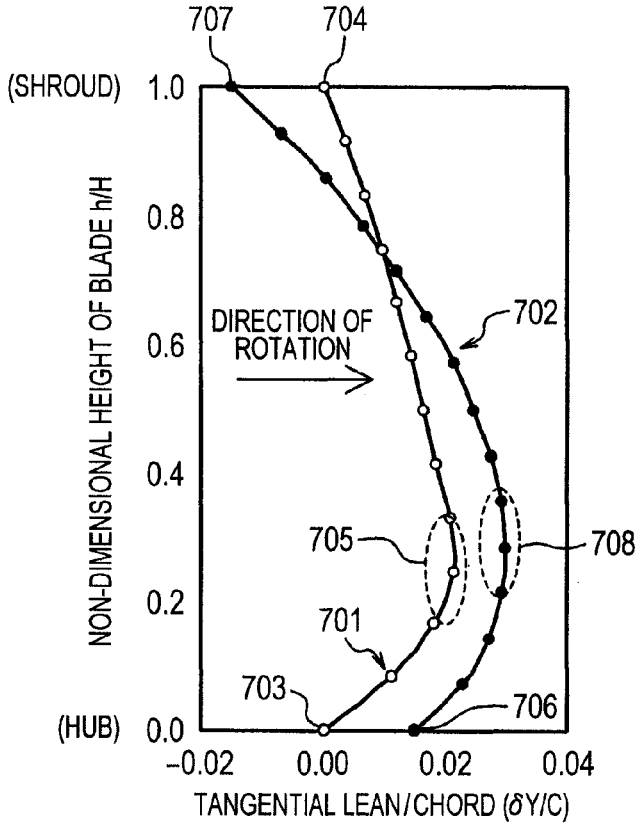
FIG. 7 is a diagram illustrating an example of application of a tangential lean.

Next, examples of the curvilinear element impeller 600 configured to freely control the above mentioned secondary flow formed between blades will be described with reference to FIG. 7 and FIG. 8. FIG. 7 illustrates one example of the curvilinear element impeller 600 to which the tangential lean 6Y has been applied. The horizontal axis indicates a value obtained by nondimensionalizing the rotational moving (Tangential lean) amount δY of a blade section with the blade chord C. The vertical axis indicates the non-dimensional blade height h/H.

As a manner of applying the tangential lean δY, the tangential lean δY which is applied to a blade of a linear element impeller that serves as a comparative reference and includes a linear element which is vertical to a hub surface is increased as it goes from a hub-side blade section toward a blade section on a span intermediate part and as it goes from a shroud-side blade section toward the blade section on the span intermediate part. When the tangential lean δY is applied to the blade in the above mentioned manner, a suction surface of the blade 607 which is positioned on the rear side (in a negative direction) of a direction of rotation is recessed as illustrated in FIG. 6B. In addition, a blade section which is positioned closer to a span-wise central part than other blade sections has such a shape that it more precedes (in a positive direction) than blade sections on the hub side and the shroud side in a direction of rotation. In the above mentioned case, an angle between the suction surface of the impeller 607 and at least one of a hub surface and a shroud surface is made obtuse.

Application profiles 701 and 702 of the tangential lean δY illustrated in FIG. 7 are selected so as to fulfill the above mentioned characteristics and lead to performance improvement of the impeller. Here, since the tangential lean δY which is applied to each of the hub surface and the shroud surface is zero in the profile 701, circumferential positions of the blade sections on both the hub and shroud sides are the same as each other and hence a blade which is excellent in strength is obtained by adopting the profile 701. The profile 702 indicates that the tangential lean δY which is applied to the shroud side is made larger than the lean which is applied to the hub side such that a hub-side blade section position 706 precedes a shroud-side blade section position 707 in a direction of rotation so as to attain the performance improvement of the impeller as compared with the profile 701.

In the application profiles 701 and 702 of the tangential lean δY, blade height-wise positions 705 and 708 where the tangential lean reaches maximum values are set slightly closer to their hub sides than they are to their span center sides. The reason therefor lies in that it is known that in a centrifugal impeller and a mixed-flow impeller, the center of a blade main stream is situated closer to the hub side than it is to the shroud side in many cases and an increase in inclination of blade at a point which is situated above or below the central position of the blade main stream and deviates from the main stream leads to efficiency improvement of the impeller. Incidentally, importance of the tangential lean δY indicated along the horizontal axis in FIG. 7 does not lie in its absolute amount but lies in that a relative positional relation as mentioned above is attained with it.

Another example of the curvilinear element impeller 600 that allows control of a blade passage flow will be described with reference to FIG. 8. FIG. 8 illustrates an example of the curvilinear impeller 600 to which the sweep δM has been applied. The horizontal axis indicates a value obtained by nondimesionalizing a moving and deforming amount (the sweep) δM of a leading edge of a blade section with the blade chord C. The vertical axis indicates the non-dimensional blade height h/H. In the example, the sweep 6M is gradually increased in a direction from a hub-side blade section toward a blade section on a span intermediate part and in a direction from a shroud-side blade section toward the blade section on the span intermediate part. When the sweep δM is applied to the blade as mentioned above, the leading edge of the blade 607 has such a shape that a span-wise central part thereof is recessed toward the downstream of a flow direction. In this case, an angle between a ridge line of the leading edges of the blade 607 and at least one of the hub surface and the shroud surface is made acute when measured on the side including the blade.

Figure 8:
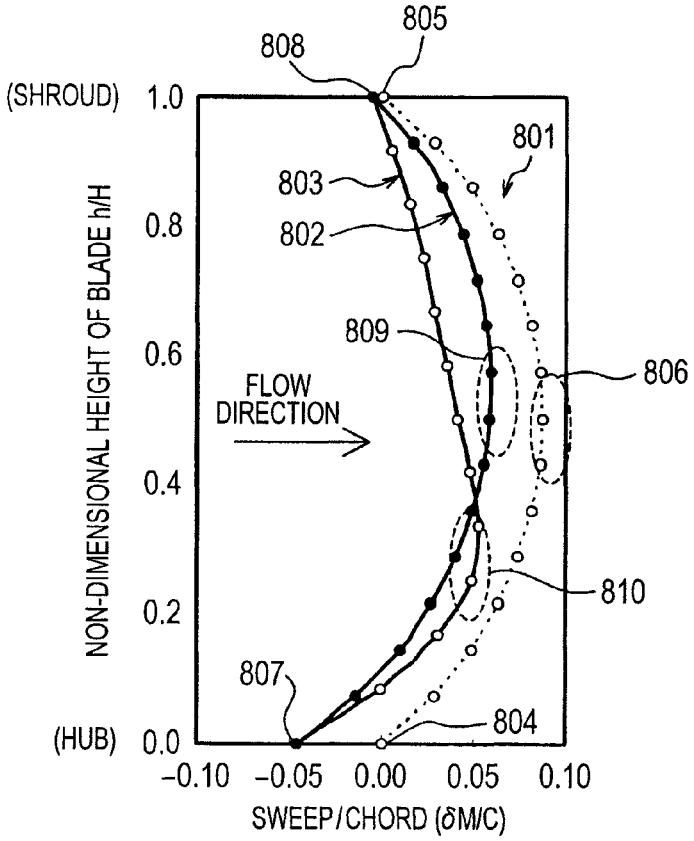
FIG. 8 is a diagram illustrating an example of application of a sweep.

FIG. 8 illustrates three application profiles 801, 802 and 803 of the sweep δM. The three application profiles 801 to 803 are obtained when the sweep δM has been applied to the blade 607 as mentioned above. The profile 801 indicates that the sweep δM is applied such that a leading edge central part 806 of the blade 607 is recessed without moving the positions of hub-side and shroud-side blade sections. Since the profile 801 is obtained only by additionally working a leading edge of a conventional impeller, the profile 801 has such an advantage that it allows ready production of an approximate curvilinear element impeller.

The application profiles 802 and 803 indicate that the sweep δM which is applied to a hub-side blade section is made relatively smaller than that applied to a shroud-side blade section so as to protrude a hub-side blade section position 807 toward the upstream side beyond a shroud-side blade section position 808, thereby to promote efficiency improvement. Incidentally, the shapes of the profiles 802 and 803 are made different from each other on their span intermediate parts. The reason therefor is as follows.

A maximum sweep position 809 of the profile 802 is set almost at a span central height. On the other hand, a maximum sweep position 810 of the profile 803 is closer to the hub side than it is to a span central height. Since, in flows in an impeller, a main stream runs deflecting toward the hub side as mentioned above, the maximum sweep position of the profile 803 is set as mentioned above in order to cope with deflection of the main stream.

Distributions in which the sweep δM is applied to the blade 607 are made different from each other as indicated in the profiles 802 and 803. Since a difference in distribution is observed only around the leading edge of the blade 607 before the main stream grows, a difference in shape of the impeller 600 between when the sweep has been applied as indicated by the profile 802 and when the sweep has been applied as indicated by the profile 803 is not so remarkably observed as when the tangential lean δY has been applied and almost the same performance improvement is attained. Incidentally, importance of the sweep δM indicated along the horizontal axis in FIG. 8 does not lie in its absolute amount but lies in that a relative positional relation as mentioned above is attained with it, as in the case of the tangential lean.

Figure 9B:
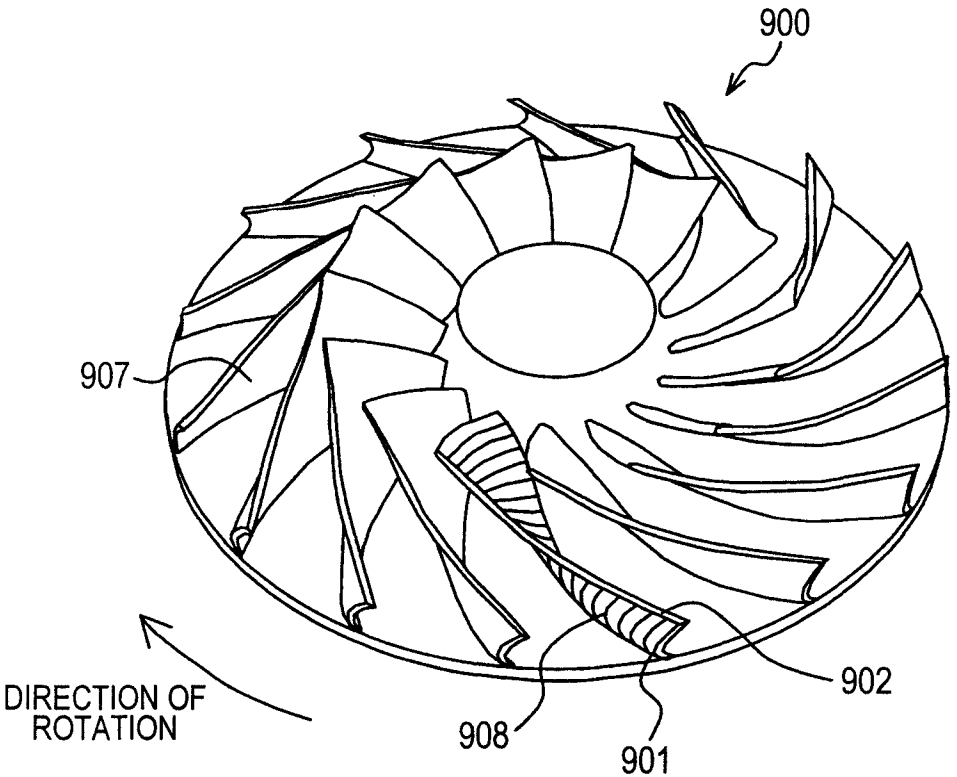
FIG. 9A and FIG. 9B are a sectional diagram of a meridional plane and a perspective view of another embodiment of the centrifugal compressor according to the present invention.
Figure 9A:
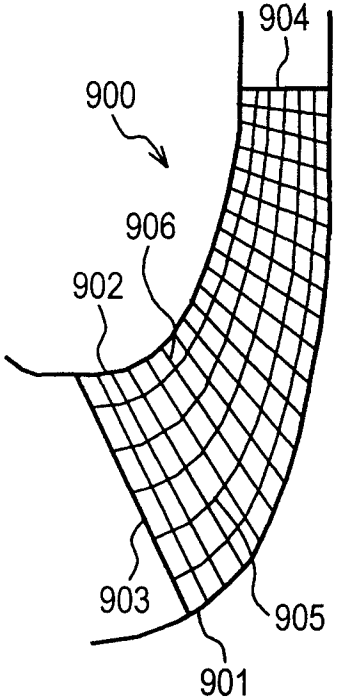

Both the tangential lean δY and the sweep δM are applied to the impeller 600 illustrated in FIG. 6A and FIG. 6B so as to have a shape with which a highest possible performance is expected. However, even when only one of the tangential lean δY and the sweep δM is applied, an impeller which is improved in performance may be obtained. FIG. 9A and FIG. 9B illustrate an example of an impeller 900 to which only the tangential lean δY has been applied.

In the impeller 900, a plurality of blades 907 are circumferentially disposed almost at equal intervals between a hub-side blade section 901 and a shroud-side blade section 902. A plurality of curvilinear elements 906 are extended from a blade leading edge 903 to a blade trailing edge 904 and blade sections 905 are piled up along the curvilinear elements 906.

Since the sweep δM is not applied to the impeller 900 according to this embodiment, a meridional plane projection drawing of the curvilinear elements 906 is straight-lined and it looks as if the blade sections 905 are piled up along the linear elements in FIG. 9A. However, since the tangential lean δY is applied to the impeller 900, it is found that the surface of the blade 907 is circumferentially curved and is configured by curvilinear elements 908 as illustrated in FIG. 9B. In the above mentioned situation, on a suction surface of the blade 907 corresponding to the rear side of a direction of rotation of the impeller 900, a hub-surface side position precedes (in a positive direction) a shroud-surface side position in the direction of rotation and a position that precedes the most in the direction of rotation is somewhat closer to the hub-surface side than it is to a span-wise central part.

Figure 10:
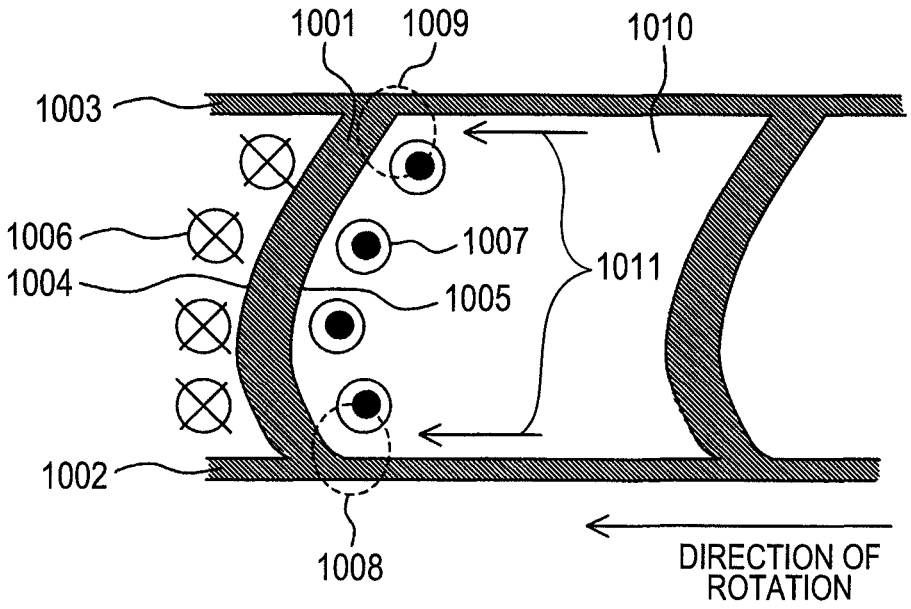
FIG. 10 is a cross section of an impeller at a certain radius, illustrating a blade passage flow, viewing from downstream side.

Next, flows in a curvilinear element impeller so configured according to the present invention will be described with reference to FIG. 10, FIG. 11A and FIG. 11B. FIG. 10 is a diagram illustrating the effect brought about by application of the tangential lean δY. In an impeller 1000 to which the tangential lean δY has been applied, a blade flow passage 1010 is defined between two adjacent blades 1001. FIG. 10 illustrates the blade flow passage 1010 in a section of a radius r (r is arbitrary) of the impeller 1000 when viewed from the downstream side.

Since the blade 1001 has a blade effect, velocities 1006 and 1007 induced by blade element vortexes generate to form a circulation around a blade. The induced velocity 1006 orients in a depth direction of the paper on a pressure surface 1004 and the induced velocity 1007 orients in a front direction of the paper on a suction surface 1005.

At a corner part 1008 where the suction surface 1005 from which a flow is liable to separate intersects with a surface of a hub plate 1002 and a corner part 1009 where the suction surface 1005 intersects with a surface of a shroud plate 1003, the density of induced velocity lines is reduced and hence the induced velocity 1007 is reduced. That is, the velocity of the flow is reduced and the pressure is increased at the corner part 1009. As a result, a secondary flow 1011 running from the pressure surface to the suction surface is restricted and accumulation of a low energy fluid onto the corner part 1009 is reduced, thereby to reduce flow loss induced by the secondary flow.

Figure 11B:
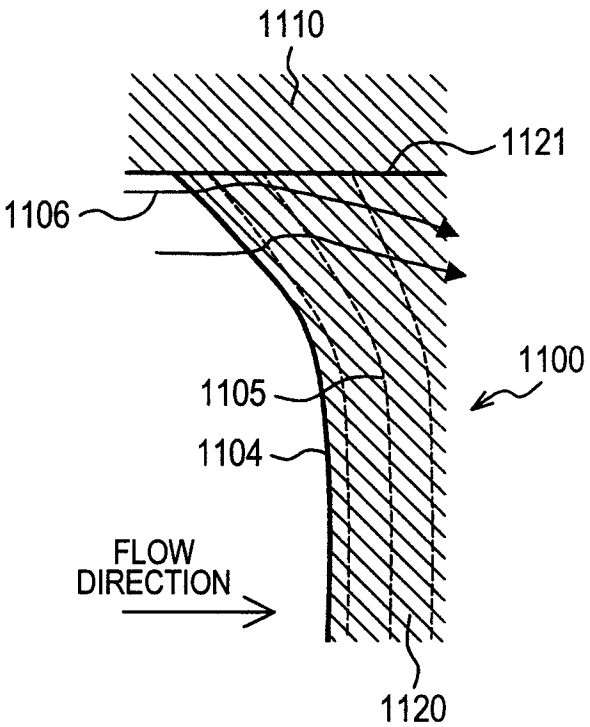
FIG. 11A and FIG. 11B are diagrams each illustrating a flow of a root part of a blade at a leading edge.
Figure 11A:
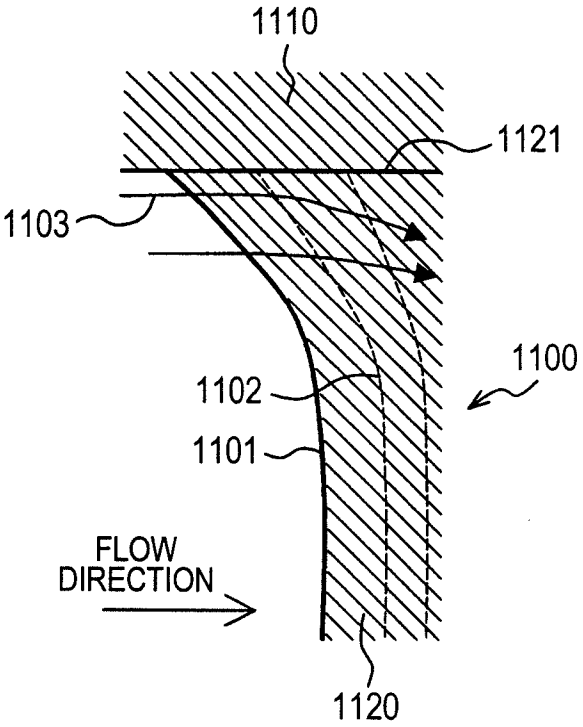

FIG. 11A and FIG. 11B are diagrams illustrating details of a part A in FIG. 6A, explaining the effect brought about by application of the sweep δM. Since the same thing also applies to a part B in FIG. 6A, only the part A will be described here. FIG. 11A and FIG. 11B diagrammatically illustrate deflecting statuses of in-flows in the vicinity of ends where leading edges 1101 and 1104 of a blade 1120 of an impeller 1100 intersect with a shroud 1110. FIG. 11A is a diagram illustrating a flow on the side of a pressure surface and FIG. 11B is a diagram illustrating a flow on the side of a suction surface. Flows deflect also in the vicinity of ends where the leading edges 1101 and 1104 of the blade 1120 intersect with a hub surface.

Since the leading edges 1101 and 1104 of the blade 1120 protrude toward the upstream in the vicinity of a shroud-side end face 1121, iso-pressure contours 1102 and 1105 on the surface of the blade 1120 are curved so as to protrude toward the downstream side. As a result, boundary layer flows 1103 and 1106 which are formed in the vicinity of the surface of the blade 1120 are bent so as to go away from the surface of the shroud 1110 as they go toward the downstream.

FIG. 11B illustrates the flow on the suction surface. Immediately after the flow has rushed at the leading edge 1104, a negative pressure is applied and the flow is drawn toward the shroud-side end face 1121 which is a corner part. Then, the flow is bent in a direction in which it goes away from the corner part 1112 as in the case on the acting face. As described above, it becomes hard for a boundary layer flow to accumulate on a part in the vicinity of the end face 1121. When a profile of the sweep δM with which the leading edge is protruded toward the upstream side is given to an impeller having the profile of the sweep δM illustrated in FIG. 8, the boundary layer flow runs in a direction opposite to that in FIG. 11A and FIG. 11B and separation is accelerated to increase the loss.

Since the concept of the tangential lean δY lies in that it is applied to circumferentially shift blade sections and then to pile them up again, the surface shape of the blade changes ranging from the leading edge to the trailing edge. On the other hand, when the sweep δM is applied to the blade, the blade is analogously deformed, so that the surface shape hardly changes on an intermediate part between the leading edge and the trailing edge and a change in appearance is observed in the vicinity of the leading edge. Therefore, the tangential lean δY is more important than the sweep δM for controlling secondary flows of a centrifugal impeller and a mixed-flow impeller and the lean and sweep are applied in this order of priority. Therefore, a secondary effect is brought by the sweep δM and application of the sweep δM is effective for performance improvement, in particular, at an off-design point where a flow in the vicinity of a leading edge of a blade becomes important. That is, although leading edge stall is liable to occur at the off-design point where an incidence angle is increased, application of the sweep may facilitate restriction of the stall.

Figure 12:
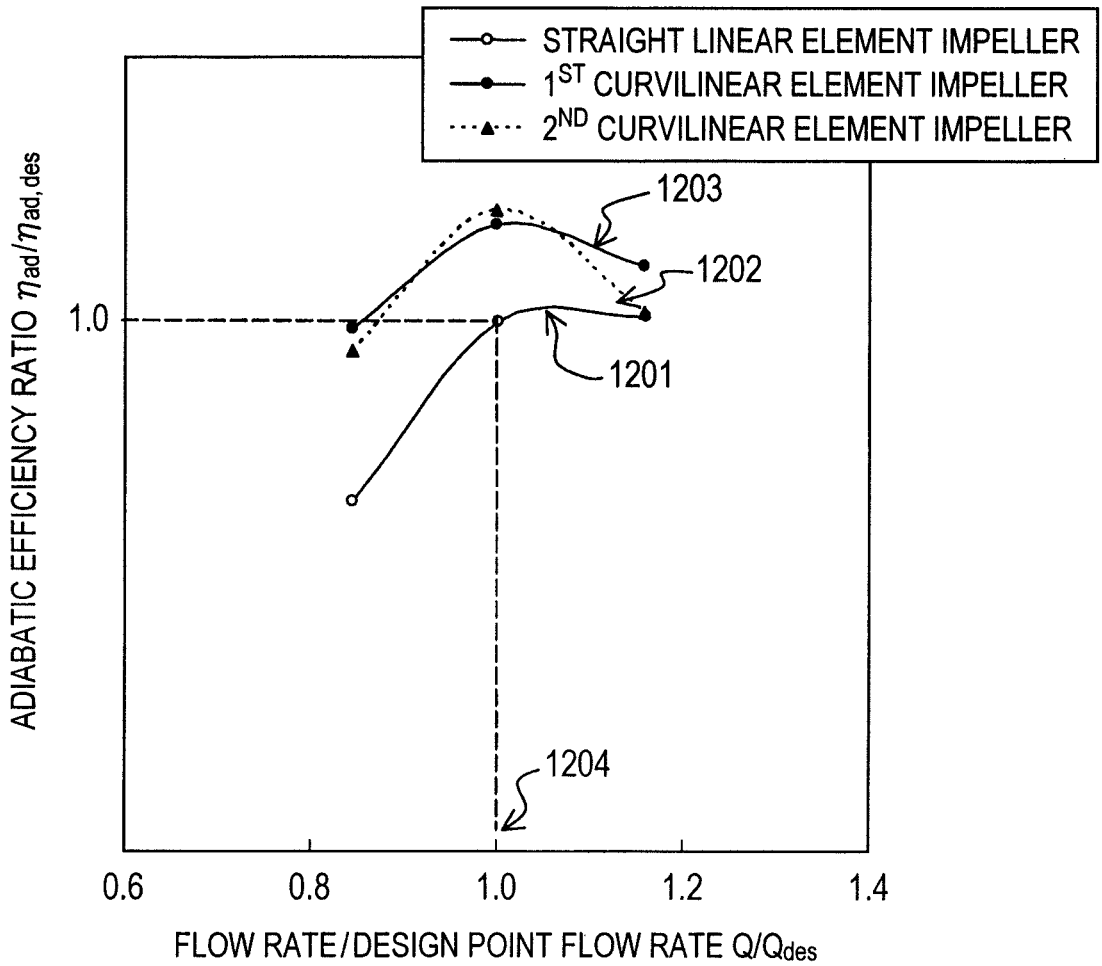
FIG. 12 is a graph illustrating efficiency curves of an embodiment of an impeller according to the present invention.

FIG. 12 illustrates a status that compressor performance curves change when the tangential lean δY and the sweep δM have been applied to a blade of an impeller described in explanation of the embodiments. FIG. 12 illustrates an adiabatic efficiency of compressor relative to a flow rate. The horizontal axis and vertical axis indicate values obtained by nondimensionalizing the adiabatic efficiency and the flow rate with a performance index of a linear impeller serving as a comparative reference. A curve 1201 indicates the performance of a related art linear element impeller as the comparative reference. A curve 1202 is a performance curve of the impeller according to an embodiment illustrated in FIG. 9A and FIG. 9B. It is found that the adiabatic efficiency at a design point 1204 will be improved by applying an appropriate tangential lean δY to the blade of the impeller.

However, in the impeller according to the embodiment illustrated in FIG. 9A and FIG. 9B, the effect of efficiency improvement is limited to a range from a smaller flow rate area to a design point flow rate area and the effect of performance improvement on the impeller is hardly observed in a larger flow rate area. On the other hand, an efficiency curve 1203 is the curve for the impeller 600 illustrated in FIG. 6A and FIG. 6B and is obtained when both the tangential lean δY and the sweep δM have been applied to the blade of the impeller 600. As described above, the efficiency may be improved over a wide flow rate range by appropriately applying the tangential lean δY and the sweep δM to the blade of the impeller.

It is allowed to implement a compressor which is restricted in secondary flow and is improved in stage efficiency by applying the tangential lean δY and the sweep δM to a blade of a curvilinear element impeller as described above. Although a case in which the tangential lean δY and the sweep δM are applied to an impeller has been described in explanation of the above mentioned embodiments, the present invention is not limited to the above mentioned embodiments. That is, the gist of the present invention lies in that a curvilinear element impeller formed by piling up blade sections needs only have the same shape as that of any one of the above mentioned embodiments, and a method of piling up the blade sections need not necessarily depend on application of the tangential lean δY and the sweep δM, various methods such as methods of parallel-moving blade sections in a blade chord direction, in a radius direction, and in a direction perpendicular to the blade chord may be used.

In addition, although it is the most favorable that shape characteristics described in the above mentioned embodiments be observed over the entire surface of a blade and across the span thereof, efficiency improvement effect will be obtained even when only a local part such as a part on the side of a hub or a shroud has shape characteristics as mentioned above.

What is claimed is:

1. An impeller, comprising: a hub plate; and a plurality of blades circumferentially disposed at intervals on one surface side of the hub plate, wherein each of the plurality of blades comprising:

a shape formed by piling up a plurality of blade sections in a blade height-wise direction of each blade;

a curved surface; and a curvilinear element connecting between a hub plate side end and a counter hub plate side end in the blade height-wise direction with curved line, when movement of the blade sections in a direction of rotation of the impeller with the shape of the blade section being maintained congruent is defined as a positive tangential lean, each of the plurality of blade sections constituting the blade has the positive tangential lean, the tangential lean applied to the each of the plurality of blade sections differs by the blade height-wise position, and the blade has a profile that the tangential lean increases from an end face of at least one of a hub plate side end and a counter hub plate side end toward a span intermediate part of the blade.

2. An impeller comprising:

a hub plate; and a plurality of blades circumferentially disposed at intervals one surface side of the hub plate, wherein each of the plurality of blades comprising:

a shape formed by piling up a plurality of blade sections in a blade height-wise direction of each blade;

a curved surface; and a curvilinear element connecting between a hub plate side end and a counter hub plate side end in the blade height-wise direction with curved line, wherein movement of the plurality blade sections in a direction of rotation of the impeller with the shape of the blade sections being maintained congruent is defined as a positive tangential lean, each of the plurality of blade sections constituting the blade has positive tangential lean, wherein a deformation of camber line of the blade section in a chord wise direction in a state that the position of the trailing edge being fixed and the shape of the camber line being maintained almost analogous is defined as a positive sweep, each chord of the plurality of blade sections constituting the blade has positive sweep, the sweep applied to each chord of the plurality of blade sections differs by the blade height-wise position, and the blade has a profile that sweep increases from an end face of at least one of a hub plate side end and a counter hub plate side end toward a span intermediate part of the blade.

3. The impeller according to claim 1, wherein the blade has a profile that the amount of the tangential lean of the hub side is larger than that a shroud side, and the plurality of blades have a profile such that a maximum value of the applied amounts is obtained at a blade height closer to the hub side than to a span central part.

4. The impeller according to claim 2, wherein the blade has a profile the amount of the tangential lean of the hub side is larger than that a shroud side, and the plurality of blades have a profile such that a maximum value of the applied amounts is obtained at a blade height closer to the hub side than to a span central part.

5. An impeller, comprising: a hub plate; and a plurality of blades which are circumferentially disposed at intervals on one surface side of the hub plate, wherein each of the plurality of blades is a curvilinear element blade formed by piling up the blade section in the blade height-wise direction comprising:

a shape formed by piling up the blade sections in a blade height-wise direction;

a curved surface; and a curvilinear element connecting between a hub plate side end and a counter hub plate side end in the blade height-wise direction with curved line, and a profile of a suction surface of each of the blades located at a hind side in the rotational direction of the impeller has a foremost position at the hub plate side than at a span intermediate part to the blade in the blade height-wise direction, in a blade section form a hub plate side end to a counter hub plate side and over the same radius.

6. Turbomachinery comprising:

at least one or more impellers according to any one of claims 1 to 4 and 5;

a diffuser;

a return guide vane;

a collector; a rotating shaft;

bearings;

a casing;

a suction nozzle; and labyrinth seals.

* * * * *